US006904834B2

(12) United States Patent
Lin

(10) Patent No.: US 6,904,834 B2
(45) Date of Patent: Jun. 14, 2005

(54) SCREW-BELT ADVANCING MECHANISM FOR A SCREW DRIVING GUN

(76) Inventor: Chao-Wei Lin, 16F-1, No. 179, Sec. 1 Chang-Jung Road, E. Dist., Tainan City (TW)

( * ) Notice: Subject to any disclaimer, the term of this patent is extended or adjusted under 35 U.S.C. 154(b) by 87 days.

(21) Appl. No.: 10/679,893

(22) Filed: Oct. 6, 2003

(65) Prior Publication Data

US 2005/0072276 A1 Apr. 7, 2005

(51) Int. Cl.[7] ..... B25B 23/06
(52) U.S. Cl. ..... 81/434; 81/435
(58) Field of Search ..... 81/57.37, 433, 81/434, 435

(56) References Cited

U.S. PATENT DOCUMENTS 5,186,085 A * 2/1993 Monacelli ..... 81/434
6,073,523 A * 6/2000 Shinjo ..... 81/434

* cited by examiner

*Primary Examiner*—Jacob K. Ackun, Jr.
(74) *Attorney, Agent, or Firm*—Curatolo Sidoti Co., LPA

(57) ABSTRACT

A screw-belt advancing mechanism of a screw driving gun includes a barrel unit, a sliding unit connected telescopically to the barrel unit and movable relative thereto between extended and retracted positions, a pivot pin mounted on the sliding unit, and a spring-biased lifting member to engage releasably a screw-retaining belt fed into the sliding unit. The lifting member is pivoted to the pivot pin, and is associated with the sliding unit in such a manner that the lifting member is moved toward the barrel unit and pivots about the pivot pin in a first direction so as to push the screw-retaining belt to a desired position, in which, a selected screw on the screw-retaining belt is aligned with a driving shaft in the barrel unit when the sliding unit slides from the extended position to the retracted position.

5 Claims, 6 Drawing Sheets

SCREW-BELT ADVANCING MECHANISM FOR A SCREW DRIVING GUN

BACKGROUND OF THE INVENTION

1. Field of the Invention

The present invention relates to a screw driving gun, more particularly to a screw-belt advancing mechanism for a screw driving gun.

2. Description of the Related Art

Referring to FIG. 1, a conventional screw driving gun 2 (illustrated in phantom lines) generally includes a driving shaft 21, a belt-retaining mechanism 1, and a screw-retaining belt unit 3. The screw-retaining belt unit 3 includes a belt body 30, a plurality of screw 31 retained releasably on the belt body 30, and a plurality of engaging holes 32, each of which is disposed between adjacent two of the screws 31.

The belt-retaining mechanism 1 includes a sliding unit 10, a barrel unit 22, and a belt-retaining member 12. The barrel unit 22 receives the driving shaft 21 therein, and has a rear end connected to the screw driving gun 2, and a front end opposite to the rear end. The sliding unit 10 is connected telescopically to the front end of the barrel unit 22, is movable relative to the barrel unit 22 between extended and retracted positions, and includes a nose plate. An urging member 221 is sleeved on the driving shaft 21 and urges the sliding unit 10 to move to the extended position. The screw-retaining belt unit 3 is fed into the sliding unit 10 via a side opening 11 and is retained on the nose plate of the sliding unit 10 by the belt-retaining member 12, which is biased frontwardly in such a manner that an engaging end 120 of the belt-retaining member 12 engages a selected one of the engaging holes 32 in the screw-retaining belt unit 3 so as to retain the belt unit 3 on the nose plate of the sliding unit 10. The engaging end 120 of the belt-retaining member 12 is formed with an inclined lower sliding face 121 which is in sliding contact with the screw-retaining belt unit 3 so as to permit disengagement of the belt body 30 from the engaging end 120 of the belt-retaining member 12 during upward pushing of the screw-retaining belt unit 3 to a position, where a selected screw 31 is aligned with the driving shaft 21.

The aforesaid conventional screw driving gun 2 is disadvantageous in that it is inconvenient and laborious to pull the screw-retaining belt unit 3 manually in order to align a selected one of the screws 31 with the driving shaft 21.

SUMMARY OF THE INVENTION

Therefore, the object of this invention is to provide a screw-belt advancing mechanism for a screw driving gun which does not require manual pulling of a screw-retaining belt so as to overcome the aforesaid disadvantage of the prior art.

Accordingly, the screw-belt advancing mechanism of the present invention is used to advance a screw-retaining belt on a screw driving gun. The screw-retaining belt supports detachably a plurality of screws thereon, and has a plurality of engaging holes, each of which is disposed between adjacent two of the screws. The screw-belt advancing mechanism includes: a barrel unit that has a front end and a rear end adapted to be connected to the screw driving gun, that is adapted to receive a driving shaft therein, and that defines a longitudinal direction; a sliding unit connected telescopically to the front end of the barrel unit, movable in the longitudinal direction relative to the barrel unit between extended and retracted positions, and including a nose plate; an urging member for urging the sliding unit to move to the extended position; a spring-biased positioning member mounted on the sliding unit and adapted to position the screw-retaining belt on the nose plate; a pivot pin mounted on the sliding unit so as to move together therewith in the longitudinal direction, and extending in a transverse direction relative to the longitudinal direction; and a spring-biased lifting member adapted to engage releasably a selected one of the engaging holes in the screw-retaining belt, pivoted to the pivot pin, and associated with the sliding unit in such a manner that the lifting member is moved in the longitudinal direction toward the rear end of the barrel unit and pivots about the pivot pin in a first direction so as to push the screw-retaining belt to move to a desired position, in which, a selected one of the screws on the screw-retaining belt is aligned with the driving shaft, when the sliding unit slides from the extended position to the retracted position against urging action of the urging member, and that the lifting member is moved in the longitudinal direction away from the rear end of the barrel unit, and pivots about the pivot pin in a second direction opposite to the first direction to engage releasably an adjacent one of the engaging holes in the screw-retaining belt which is disposed adjacent to the selected one of the engaging holes in the screw-retaining belt when the sliding unit slides from the retracted position to the extended position by virtue of the urging action of the urging member.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
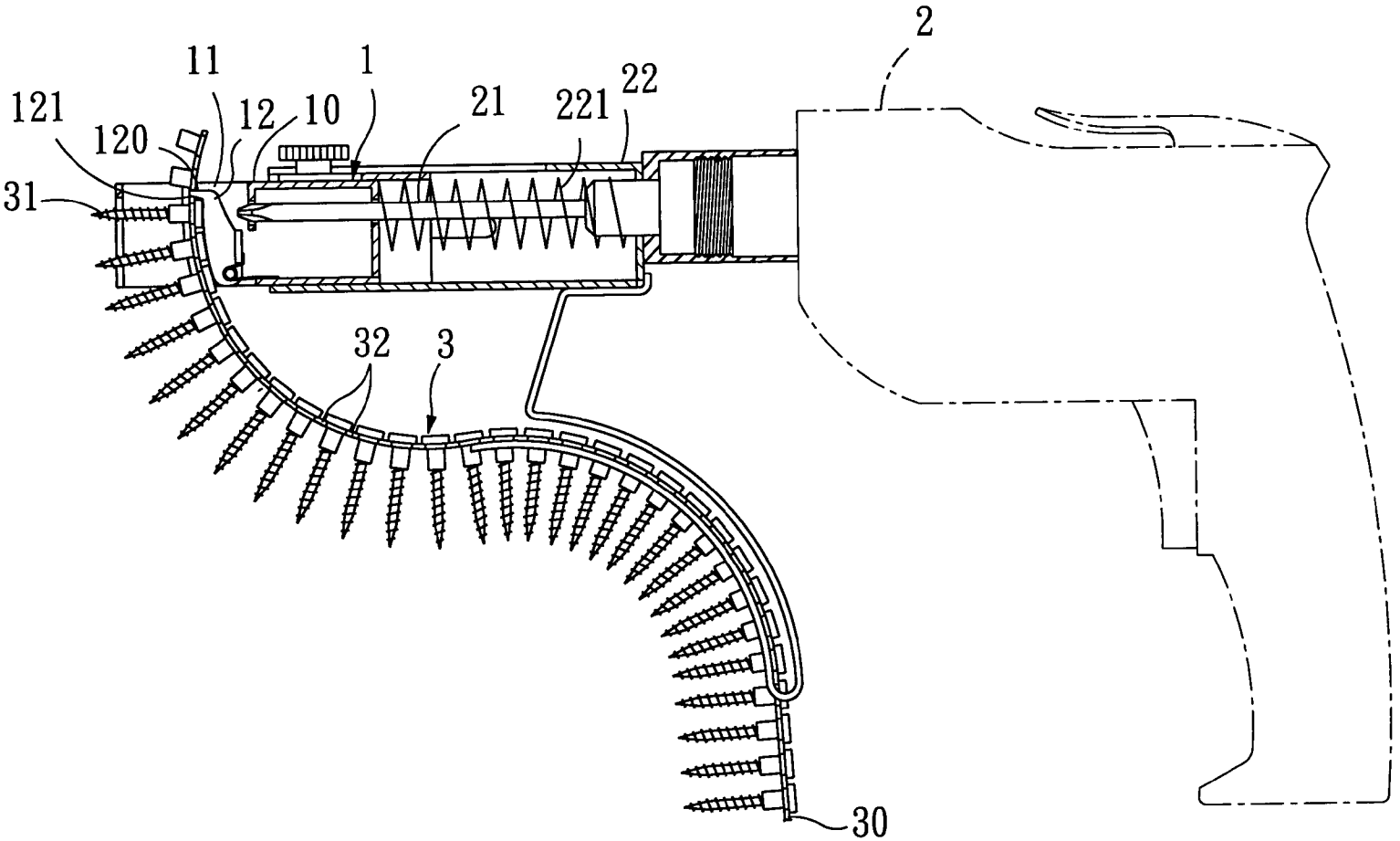
FIG. 1 PRIOR ART
FIG. 1 is a partly sectional, schematic side view of a conventional screw driving gun.

Referring to FIGS. 2 to 5, the preferred embodiment of a screw-belt advancing mechanism 5 according to the present invention is used to advancing a screw-retaining belt 9 on a screw driving gun (not shown), and is shown to include a barrel unit 6, a sliding unit 7, an urging member 62, a spring-biased positioning member 54, a pivot pin 95, and a spring-biased lifting member 52.

As illustrated, the screw-retaining belt 9 supports detachably a plurality of screws 90 thereon, and has a plurality of engaging holes 91, each of which is disposed between adjacent two of the screws 90.

The barrel unit 6 includes a casing 60 that has a front end 601 and a rear end 602 adapted to be connected to the screw driving gun (not shown), that is adapted to receive a driving shaft 65 therein, and that defines a longitudinal direction.

The sliding unit 7 is connected telescopically to the front end 601 of the casing 60, is movable in the longitudinal direction relative to the casing 60 between extended and retracted positions, and includes a nose plate 514.

Figure 2:
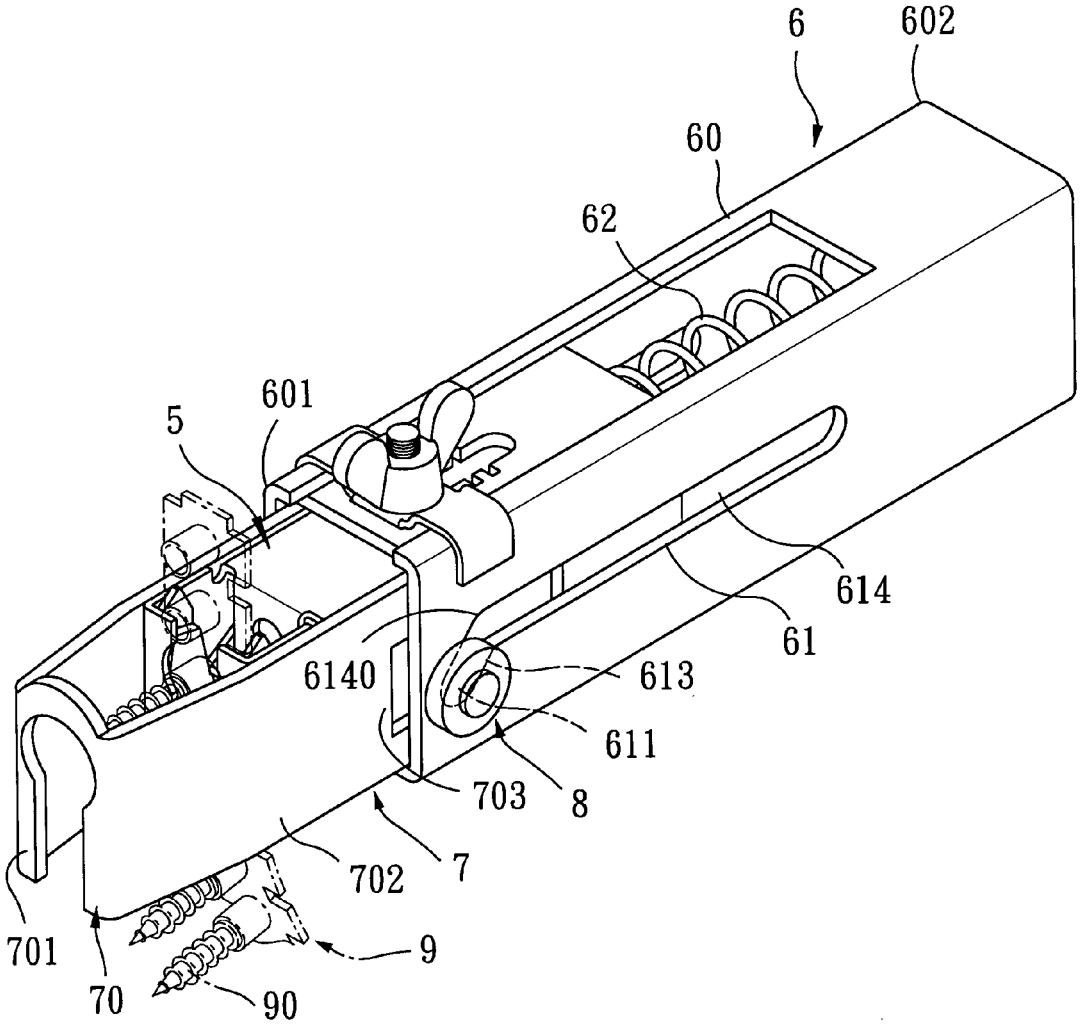
FIG. 2 is a perspective view of the preferred embodiment of a screw-belt advancing mechanism for a screw driving gun according to the present invention.
Figure 3:
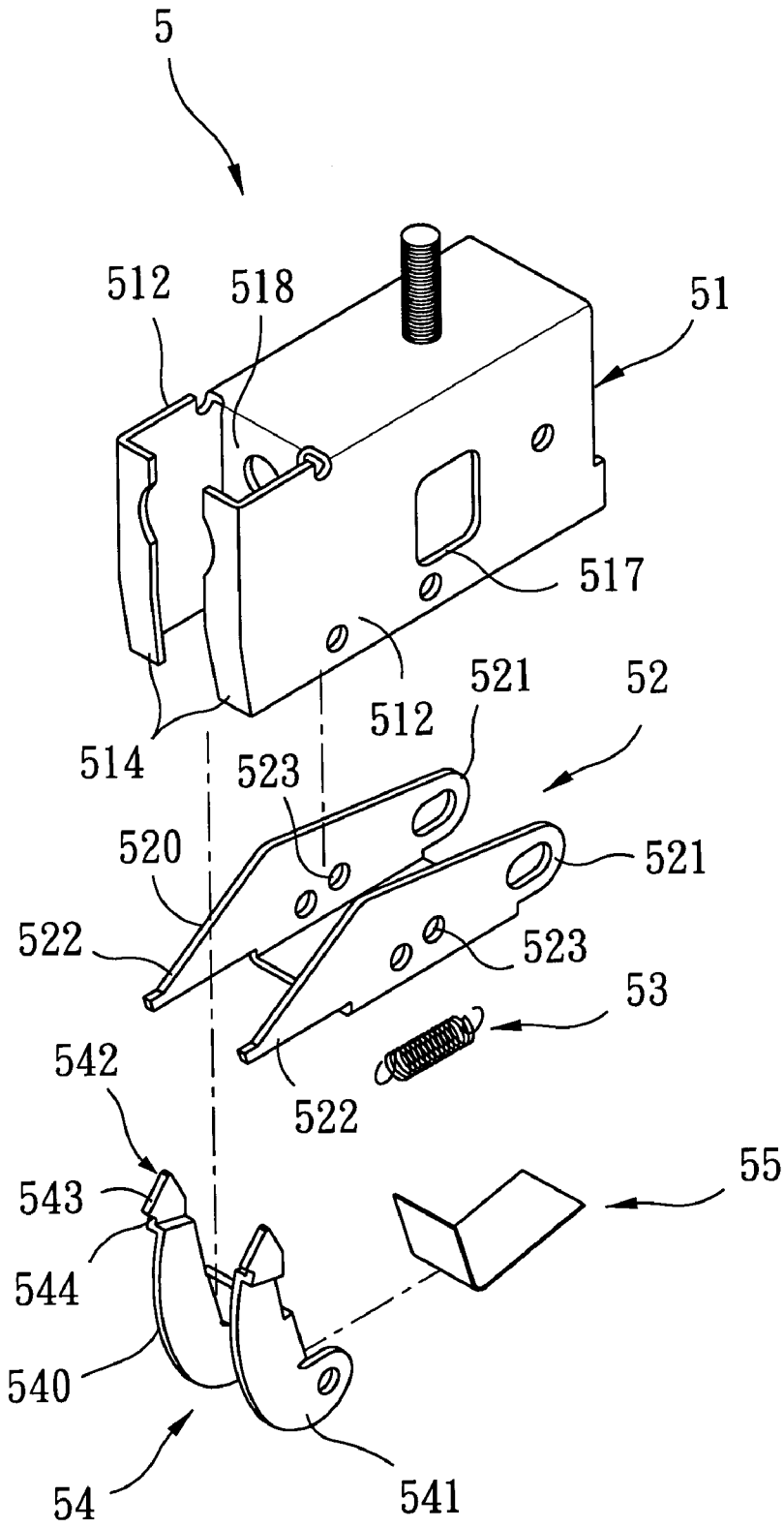
FIG. 3 is an exploded perspective view of a portion of the preferred embodiment.
Figure 4:
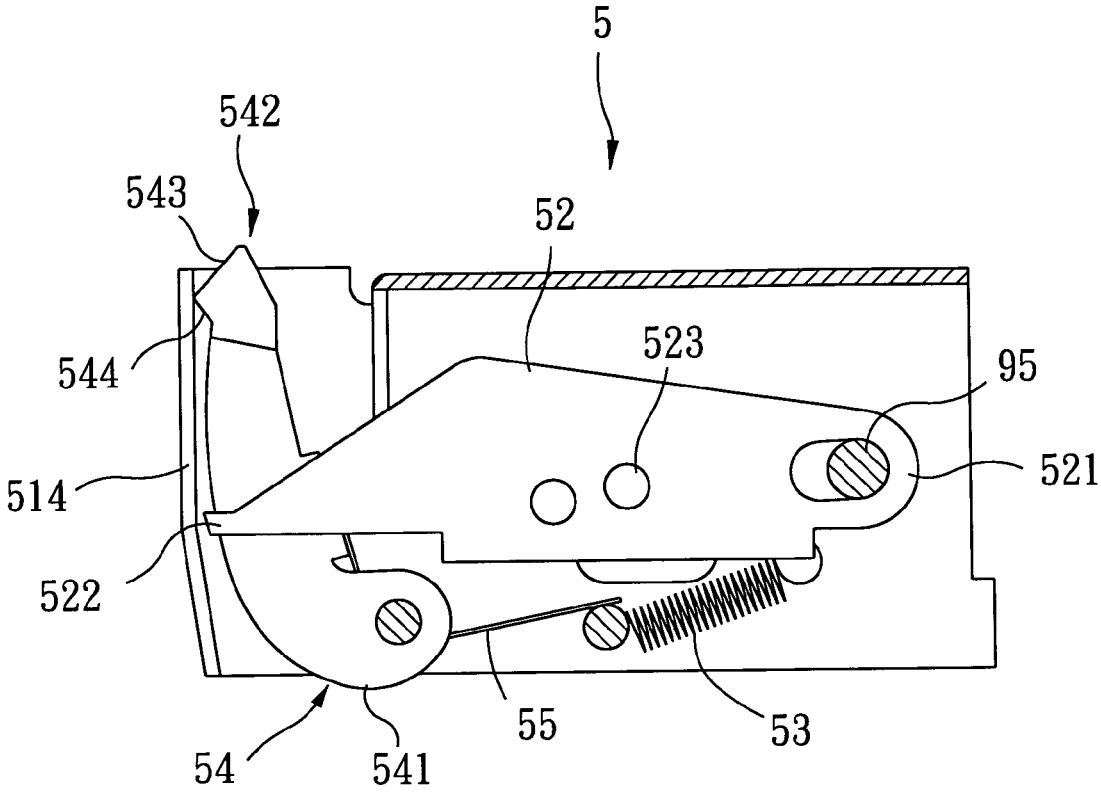
FIG. 4 is a fragmentary partly sectional view illustrating details and connecting relationship of components of the preferred embodiment.

The urging member 62, preferably a compression spring, is sleeved on the driving shaft 65, and urges the sliding unit 7 to move to the extended position, as best shown in FIG. 2.

Figure 5:
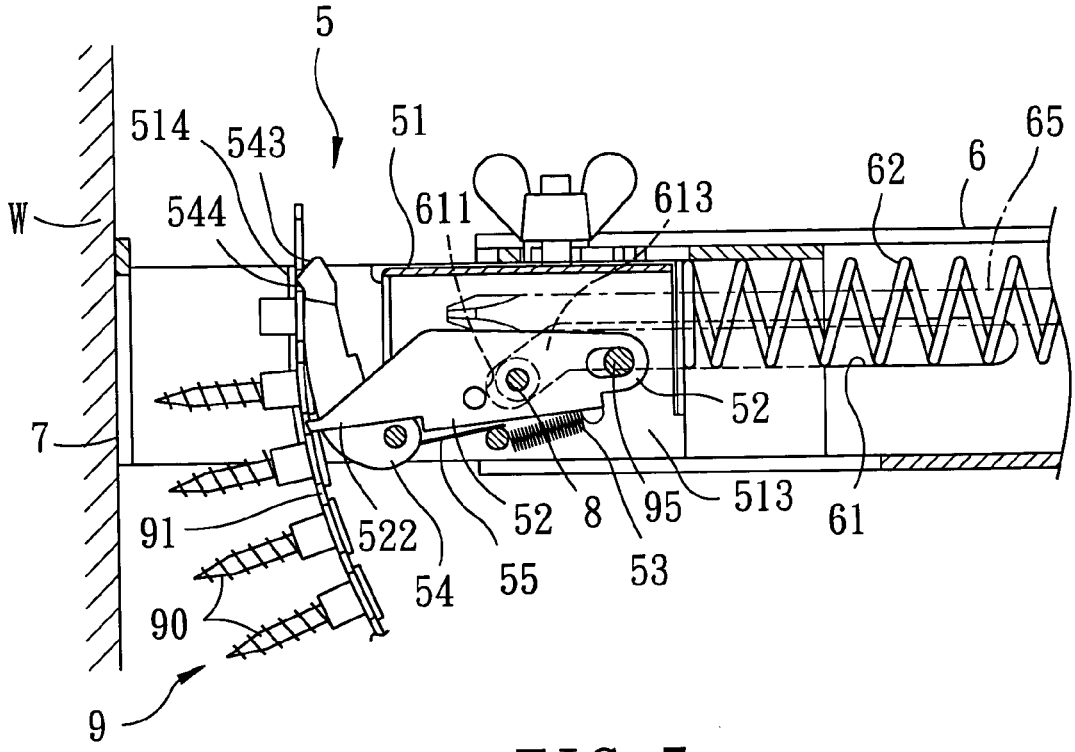
FIG. 5 is a fragmentary partly sectional view of the preferred embodiment, illustrating a state prior to pivoting movement of a lifting member about a pivot pin.

The positioning member 54 includes two interconnected positioning arms 540 having pivot ends 541 pivoted on the sliding unit 7, and engaging ends 542 opposite to the pivot ends 541. A spring plate 55 is disposed within the sliding unit 7, and urges constantly the positioning arms 540 in such a manner that the engaging ends 542 of the positioning arms 540 engage releasably the screw-retaining belt 9 so as to position the screw-retaining belt 9 on the nose plate 514 of the sliding unit 7, as best shown in FIG. 5. Each of the engaging ends 542 of the positioning arms 540 is formed with an inclined lower sliding side 544 which is in sliding contact with the screw-retaining belt 9 so as to permit disengagement of the positioning arms 540 from the screw-retaining belt 9 and so as to permit advancement of the screw-retaining belt 9 upon movement of the lifting member 52, which will be described in greater detail hereinafter.

The pivot pin 95 is mounted on the sliding unit 7 so as to move together therewith in the longitudinal direction, and extends in a transverse direction relative to the longitudinal direction.

Figure 6:
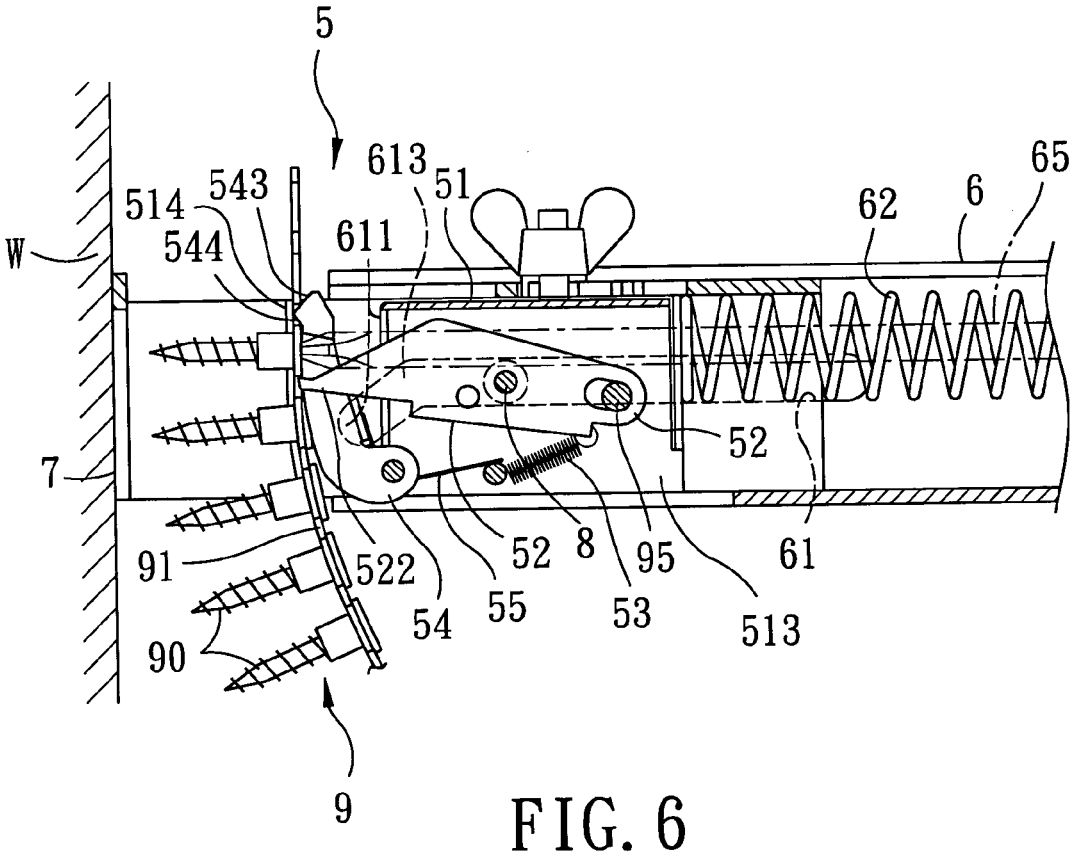
FIG. 6 is a fragmentary partly sectional view of the preferred embodiment, illustrating how pivoting movement of the lifting member about the pivot pin aligns a selected screw with a driving shaft.

The spring-biased lifting member 52 engages releasably a selected pair of the engaging holes 91 in the screw-retaining belt 9, is pivoted to the pivot pin 95, and is associated with the sliding unit 7 in such a manner that when the sliding unit 7 slides due to an applied force from the extended position of FIG. 5 to the retracted position of FIG. 6 against urging action of the urging member 62, the lifting member 52 moves in the longitudinal direction toward the rear end 602 of the casing 60, and pivots about the pivot pin 95 in a first direction so as to push the screw-retaining belt 9 to move to a desired position, in which, a selected one of the screws 90 on the screw-retaining belt 9 is aligned with the driving shaft 65. Under this condition, the selected screw 90 can be driven into a workpiece (W), such as a wall, upon rotation of the driving shaft 65. When the applied force is removed, the sliding unit 7 slides from the retracted position to the extended position by virtue of the urging action of the urging member 62, which, in turn, results in movement of the lifting member 52 in the longitudinal direction away from the rear end 602 of the casing 60, and simultaneous rotation of the lifting member 52 about the pivot pin 95 in a second direction opposite to the first direction to engage releasably an adjacent pair of the engaging holes 91 in the screw-retaining belt 9 which are disposed adjacent to the selected pair of the engaging holes 91 in the screw-retaining belt 9. Note that each of the engaging ends 542 of the positioning arms 540 is further formed with an inclined upper sliding side 543 which is in sliding contact with the screw-retaining belt 9 so as to permit downward movement of the belt 9 in case the latter is pulled downward, such as, when removing the screw-retaining belt 9 from the sliding unit 7.

In the preferred embodiment, the casing 60 is formed with a pair of opposite guiding slots 61, each of which includes a straight section 614 that extends in the longitudinal direction and that has a front end 6140, and a sloped section 613 that extends inclinedly and downwardly from the front end 6140 of the straight section 614 and that has a front end 611 which is disposed at an elevation lower than the front end 6140 of the straight section 614. The lifting member 52 includes two interconnected lifting arms 520. Each of the lifting arms 520 has a pivot end 521 pivoted to the pivot pin 95, a driving end 522 opposite to the pivot end 521 and engaging releasably the selected engaging holes 91 in the screw-retaining belt 9, and an intermediate portion extending between the driving and pivot ends 521, 522. The intermediate portion of each of the lifting arms 520 is formed with a mounting hole 523. The sliding unit 7 includes a lifting lever 8 that is parallel to the pivot pin 95, and that extends through the mounting holes 523 in the lifting arms 520 and the guiding slots 61 in the casing 60 so as to permit pivoting movement of the lifting arms 520 about the pivot pin 95 during sliding movement of the lifting lever 8 between the front ends 611 of the sloped sections 613 and the front ends 6140 of the straight sections 614 when the sliding unit 7 is slid between the extended position and the retracted position.

The sliding unit 7 further includes a mounting seat 51 and a sliding frame 70. The mounting seat 51 is disposed slidably in the casing 60, has a front plate projecting frontwardly and outwardly from the front end 601 of the casing 60 to define the nose plate 514, and two side plates 512 that extend rearwardly from two opposite ends of the nose plate 514 into the casing 60 to define a receiving space therebetween for receiving the lifting member 52 therein and that are formed with openings 517 registered with the mounting holes 523 in the lifting arms 520 and permitting extension of the lifting lever 8 therethrough. The pivot ends 521 of the lifting arms 520 are pivoted to the side plates 512 of the mounting seat 51 through the pivot pin 95, which is disposed rearwardly of the openings 517 in the side plates 512 of the mounting seat 51. The mounting seat 51 is further formed with a spring-abutting plate 518 that is disposed rearwardly of the nose plate 514, that interconnects the side plates 512 of the mounting seat 51, and that abuts against one end of the urging member 62. The sliding frame 70 is interposed between the mounting seat 51 and the casing 60, and is associated with the mounting seat 51 in such a manner so as to be movable together therewith relative to the casing 60 between the extended and retracted positions. The sliding frame 70 has an abutment plate 701 disposed frontwardly of and cooperating with the nose plate 514 of the mounting seat 51 to define a screw-receiving chamber therebetween for receiving the selected screw 90, and a pair of side plates 702 that extend rearwardly and respectively from opposite ends of the abutment plate 701 into the casing 60, that overlap the side plates 512 of the mounting seat 51 and that are formed with two openings 703 registered with the openings 517 in the side plates 512 of the mounting seat 51 to permit extension of the lifting lever 8 therethrough.

The screw-belt advancing mechanism 5 further includes a second urging member 53 having one end fixed to the side plates 512 of the mounting seat 51, and an opposite end connected to the pivot ends 521 of the lifting arms 520 so as to urge the lifting arms 520 to move toward the nose plate 514 of the sliding unit 7.

Figure 7:
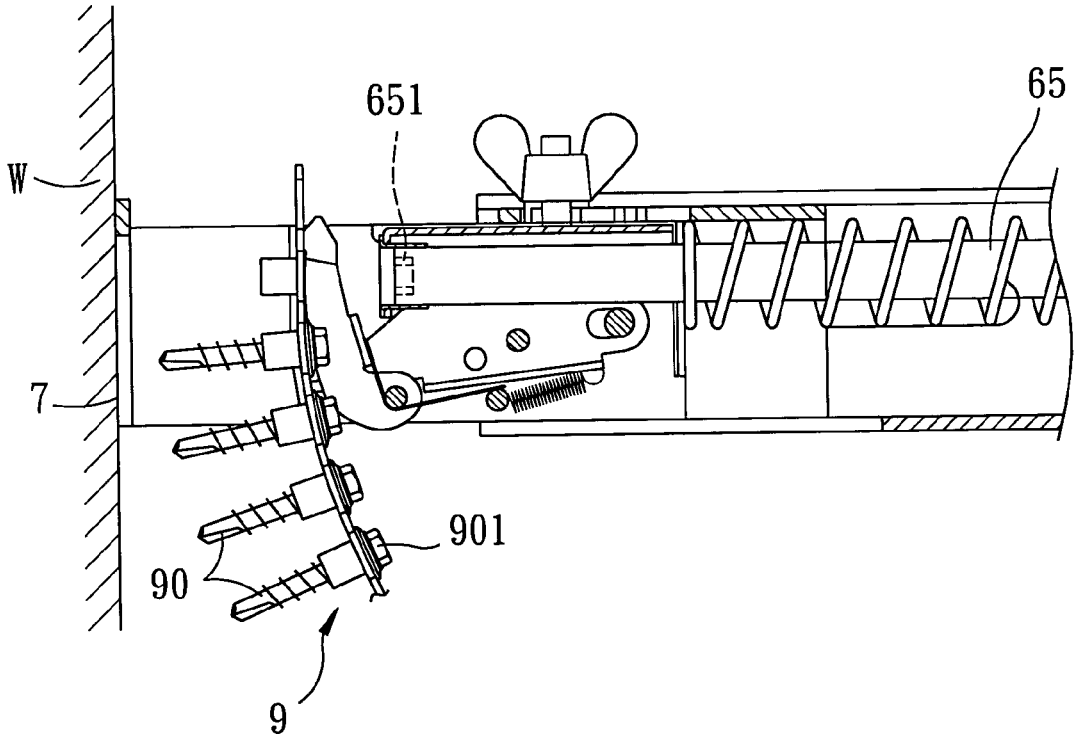
FIG. 7 is a fragmentary partly sectional view of a modified preferred embodiment of a screw-belt advancing mechanism for a screw driving gun according to the present invention.

Referring to FIG. 7, a modified preferred embodiment of the present invention is shown to have a construction similar to that of the previous embodiment, except that the driving shaft 65 is formed with a hexagonal hole 651 in order to receive the hexagonal head 901 of the screw 90 on the screw-retaining belt 9.

During the screw driving operation, the sliding frame 70 is pressed against the workpiece (W), which, in turn, results in movement of the sliding unit 7 to the retracted position and alignment of the selected screw 90 with the driving shaft 65. The aforesaid disadvantage of the prior art is thus eliminated by the mechanism of the present invention.

With this invention thus explained, it is apparent that numerous modifications and variations can be made without departing from the scope and spirit of this invention. It is therefore intended that the invention be limited only as indicated in the appended claims.

I claim:

1. A screw-belt advancing mechanism for advancing a screw-retaining belt on a screw driving gun, the screw-retaining belt supporting detachably a plurality of screws thereon, and having a plurality of engaging holes, each of the engaging holes being disposed between adjacent two of the screws on the screw-retaining belt, said screw-belt advancing mechanism comprising:

a barrel unit that has a front end and a rear end adapted to be connected to the screw driving gun, that is adapted to receive a driving shaft therein, and that defines a longitudinal direction;

a sliding unit connected telescopically to said front end of said barrel unit, movable in said longitudinal direction relative to said barrel unit between extended and retracted positions, and including a nose plate;

an urging member for urging said sliding unit to move to said extended position;

a spring-biased positioning member mounted on said sliding unit and adapted to position the screw-retaining belt on said nose plate;

a pivot pin mounted on said sliding unit so as to move together therewith in said longitudinal direction, and extending in a transverse direction relative to said longitudinal direction; and a spring-biased lifting member adapted to engage releasably a selected one of the engaging holes in the screw-retaining belt, pivoted to said pivot pin, and associated with said sliding unit in such a manner that said lifting member is moved in said longitudinal direction toward said rear end of said barrel unit and pivots about said pivot pin in a first direction so as to push the screw-retaining belt to move to a desired position, in which, a selected one of the screws on the screw-retaining belt is aligned with the driving shaft, when said sliding unit slides from said extended position to said retracted position against urging action of said urging member, and that said lifting member is moved in said longitudinal direction away from said rear end of said barrel unit and pivots about said pivot pin in a second direction opposite to said first direction to engage releasably an adjacent one of the engaging holes in the screw-retaining belt which is disposed adjacent to the selected one of the engaging holes in the screw-retaining belt when said sliding unit slides from said retracted position to said extended position by virtue of the urging action of said urging member.

2. The screw-belt advancing mechanism as defined in claim 1, wherein said barrel unit includes a casing formed with a pair of opposite guiding slots, each of which includes a straight section extending in said longitudinal direction and having a front end, and a sloped section extending inclinedly and downwardly from said front end of said straight section and having a front end, said lifting member having a pivot end pivoted to said pivot pin, a driving end opposite to said pivot end and engaging releasably the selected one of the engaging holes in the screw-retaining belt, and an intermediate portion extending between said driving and pivot ends and formed with a mounting hole, said sliding unit including a lifting lever parallel to said pivot pin and extending through said mounting hole in said lifting member and said guiding slots in said casing so as to permit pivoting movement of said lifting member about said pivot pin during sliding movement of said lifting lever between said front end of said sloped section and said front end of said straight section when said sliding unit is slid between said extended position and said retracted position.

3. The screw-belt advancing mechanism as defined in claim 2, wherein said sliding unit further includes a mounting seat that is disposed slidably in said casing, that has a front plate projecting frontwardly and outwardly from said front end of said barrel unit to define said nose plate, and two side plates that extend rearwardly from two opposite ends of said nose plate into said casing to define a receiving space therebetween for receiving said lifting member therein and that are formed with openings respectively registered with said mounting hole in said lifting member and permitting extension of said lifting lever therethrough, said pivot end of said lifting member being pivoted to said side plates of said mounting seat through said pivot pin which is disposed rearwardly of said openings in said side plates of said mounting seat.

4. The screw-belt advancing mechanism as defined in claim 3, wherein said mounting seat is formed with a spring-abutting plate that is disposed rearwardly of said nose plate, that interconnects said side plates of said mounting seat, and that abuts against one end of said urging member.

5. The screw-belt advancing mechanism as defined in claim 4, further comprising a second urging member having one end fixed to said side plates of said mounting seat and an opposite end connected to said pivot end of said lifting member so as to constantly urge said lifting member to move toward said nose plate of said sliding unit.

* * * * *